US006875733B1

(12) United States Patent
Wojtczak et al.

(10) Patent No.: US 6,875,733 B1
(45) Date of Patent: Apr. 5, 2005

(54) AMMONIUM BORATE CONTAINING COMPOSITIONS FOR STRIPPING RESIDUES FROM SEMICONDUCTOR SUBSTRATES

(75) Inventors: William A. Wojtczak, Austin, TX (US); George Guan, San Jose, CA (US)

(73) Assignee: Advanced Technology Materials, Inc., Danbury, CT (US)

( * ) Notice: Subject to any disclaimer, the term of this patent is extended or adjusted under 35 U.S.C. 154(b) by 0 days.

(21) Appl. No.: 09/529,496

(22) PCT Filed: Oct. 14, 1998

(86) PCT No.: PCT/US98/21807

§ 371 (c)(1),
(2), (4) Date: Mar. 3, 2003

(87) PCT Pub. No.: WO99/19447

PCT Pub. Date: Apr. 22, 1999

(51) Int. Cl.[7] ..... C11D 3/30; C11D 9/16

(52) U.S. Cl. ..... 510/175; 510/176; 510/178; 510/212; 510/432; 510/420; 510/465; 510/499; 252/79.1; 252/79.4; 134/1.2; 134/1.3

(58) Field of Search ..... 510/175, 176, 510/178, 212, 432, 420, 465, 499; 252/79.1, 79.4; 134/1.2, 1.3

(56) References Cited

U.S. PATENT DOCUMENTS 3,887,497 A * 6/1975 Ulvild ..... 510/420
6,224,785 B1 * 5/2001 Wojtczak et al. ..... 252/79.1

* cited by examiner

*Primary Examiner*—Charles Boyer
(74) *Attorney, Agent, or Firm*—Margaret Chappuis; Steven Hultquist, Esq.

(57) ABSTRACT

The present invention comprises formulations for stripping wafer residues which originate from a halogen based plasma metal etching followed by oxygen plasma ashing. The formulations contain the following general components (percentages are by weight): an organic amine or mixture of amines 15–60 %, water 20–60 %, ammonium tetraborate or ammonium pentaborate 9–20 %, an optional polar organic solvent 0–15 %.

26 Claims, No Drawings

AMMONIUM BORATE CONTAINING COMPOSITIONS FOR STRIPPING RESIDUES FROM SEMICONDUCTOR SUBSTRATES

BACKGROUND OF THE INVENTION

1. Field of the Invention

The present invention relates generally to chemical formulations used in semiconductor wafer fabrication and particularly to chemical formulations, including an ammonium borate compound that are utilized to remove residue from wafers following a resist plasma ashing step.

2. Description of the Prior Art

The prior art teaches the utilization of various chemical formulations to remove residue and clean wafers following a photoresist ashing step. Generally, these prior art chemical formulations include strong reagents such as strong acids or strong bases to help remove unwanted inorganic residues. However, such strong reagents can cause unwanted further removal of metal or insulator layers remaining on the wafer and are therefore undesirable in many instances. There is therefore a need for chemical formulations which effectively remove residue following a resist ashing step which do not attack and potentially degrade delicate structures which are meant to remain on a wafer.

SUMMARY OF THE INVENTION

The present invention comprises formulations for stripping wafer residues which originate from a halogen based plasma metal etching followed by oxygen plasma ashing. The formulations contain the following general components (percentages are by weight):

| | |
|---|---|
| An organic amine or mixture of amines | 15–60% |
| Water | 20–60% |
| Ammonium tetraborate or ammonium pentaborate | 9–20% |
| An optional polar organic solvent | 0–15% |
| The preferred amines are: | |
| Monoethanolamine (MEA) | |
| Pentamethyldiethylenetriamine (PMDETA) | |
| Triethanolamine (TEA) | |
| Preferred formulations include: | |
| One or more of the preferred amines | 35–57% |
| Ammonium tetraborate | 10–20% |
| Water | 28–49% |
| N-Methylpyrrolidone | 0–15% |
| Examples of preferred formulations are: | |
| TEA | 35.2% |
| Ammonium tetraborate | 11.4% |
| Water | 39% |
| N-Methylpyrrolidone | 14.3% |
| MEA | 35% |
| Ammonium tetraborate | 20% |
| Water | 45% |

It is an advantage of the present invention that it effectively removes inorganic residues following a plasma ashing step.

It is another advantage of the present invention that it effectively removes metal halide and metal oxide residues following plasma ashing.

It is a further advantage of the present invention that it effectively removes inorganic residue from a semiconductor wafer following plasma ashing without containing a strong acid or a strong base.

These and other features and advantages of the present invention will become understood to those of ordinary skill in the art upon review of the following detailed description of the preferred embodiments.

DETAILED DESCRIPTION OF THE PREFERRED EMBODIMENTS

Typical steps in the fabrication of semiconductor wafers involve the creation of metalized layers or insulating layers having patterned resist layers formed thereon. Such a wafer may then be exposed to plasmas (such as halogen based plasmas) to remove exposed metal or insulator. Thereafter, a plasma ashing step is conducted (typically using an oxygen based plasma) in which the remaining resist is removed from the wafer. The result is a patterned metal layer or a patterned insulator layer.

This series of steps generally results in a residue which must be removed from the wafer prior to further fabrication steps. The residue following the plasma ashing step is predominantly composed of inorganic compounds such as metal halides and metal oxides.

Various chemical formulations are currently used to remove the inorganic compound residues. These formulations are generally holdovers from older semiconductor fabrication wet chemical resist removal processes that were used prior to the introduction of the resist plasma ashing technology. The prior formulations thus typically contain strong acids or strong bases to remove residues. The present invention comprises chemical formulations for the removal of inorganic compound residues, where the formulations do not contain strong acids or strong bases of the prior art formulations.

The present invention comprises new formulations for stripping wafer residues which originate from high density plasma metal etching followed by plasma ashing. The formulations contain amines and ammonium borates and water or another solvent as primary ingredients.

The preferred formulations utilize the following general components (percentages are by weight):

| | |
|---|---|
| An organic amine or mixture of amines | 15–60% |
| Water | 20–60% |
| Ammonium tetraborate or ammonium pentaborate | 9–20% |
| An optional polar organic solvent | 0–15% |
| The preferred amines are: | |
| Monoethanolamine (MEA) | |
| Pentamethyldiethylenetriamine (PMDETA) | |
| Triethanolamine (TEA) | |
| Other amines that are effective are: | |
| N-Methyldiethanolamine | |
| Diglycolamine | |
| Diethylethanolamine | |
| Hydroxyethylmorpholine | |
| Preferred formulations include: | |
| One or more of the preferred amines | 35–57% |
| Ammonium tetraborate | 10–20% |
| Water | 28–49% |
| N-Methylpyrrolidone | 0–15% |

The utilization of borates as metal-chelating agents in combination with amines are unique features of this invention. These formulations provided good stripping performance and considerably less corrosivity than traditional formulations containing amines and other chelating agents. Borate/amine combinations are not known to have been utilized in commercial strippers.

Examples of preferred formulations are:

| | |
|---|---|
| TEA | 35.2% |
| Ammonium tetraborate | 11.4% |
| Water | 39% |
| N-Methylpyrrolidone | 14.3% |
| MEA | 35% |
| Ammonium tetraborate | 20% |
| Water | 45% |

The inventors expect that other closely related ingredients would be expected to show comparable performance to those utilized in the preferred formulations.

These include:

A. Other organic amines are expected to be suitable:

B. Other polar organic solvents are expected to be suitable .

C. It would also b e expected that inclusion of optional components such as surfactants, stabilizers, corrosion inhibitors, buffering agents, and cosolvents would constitute obvious additions to those practiced in the art.

The formulations of the present invention are particularly useful on wafers which have been etched with chlorine- or fluorine-containing plasmas followed by oxygen plasma ashing. The residues generated by this type of processing typically contain inorganic materials such as, but not limited to, aluminum oxide and titanium oxide. These residues are often difficult to dissolve completely without causing corrosion on of metal and titanium nitride features required for effective device performance.

EXAMPLES

Two types of commercially generated wafers containing vias were evaluated using the formulations of the present invention. In each case, following plasma etching and ashing the residue was removed from the wafer by immersion of the wafer in a formulation bath at 50°–60° for 30 minutes followed by washing with deionized water and drying with a stream of nitrogen gas. It is expected by the inventors that the formulations can also be applied by spraying onto the wafers in an automated spray tool followed by a water rinse.

Example 1.

A wafer having 1.6 micron diameter, three layer vias comprised of a titanium nitride top layer (40 nm thick), a second layer of silicon oxide (1.3 microns thick), and a bottom layer of aluminum/copper alloy. The substrate was silicon oxide.

| | |
|---|---|
| TEA | 35.2% |
| Ammonium tetraborate | 11.4% |
| Water | 39% |
| N-Methylpyrrolidone | 14.3% |
| MEA | 35% |
| Ammonium tetraborate | 20% |
| Water | 45% |

Example 2.

A wafer having one micron diameter, three layer vias comprised of a silicon oxide top layer (7000 angstroms thick), a second layer of titanium nitride (1200 angstroms thick), and a bottom layer of aluminum. The substrate was silicon oxide.

| | |
|---|---|
| TEA | 35.2% |
| Ammonium tetraborate | 11.4% |
| Water | 39% |
| N-Methylpyrrolidone | 14.3% |
| MEA | 35% |
| Ammonium tetraborate | 20% |
| Water | 45% |

The present invention formulations were rated for relative stripping effectiveness and corrosivity. The preferred formulations scored best and, in overall performance based on both stripping effectiveness and low corrosivity, are approximately equal.

While the present invention has been shown and described with reference to particular preferred embodiments, it is to be understood that other and further changes and modifications of the will become apparent to those skilled in the art after understanding the present invention. It is therefore intended that the following claims cover all such alterations and modifications as fall within the true spirit and scope if the invention.

We claim:

1. A semiconductor wafer cleaning formulation for use in post plasma ashing semiconductor fabrication comprising the following components in the percentage by weight ranges shown:

| | |
|---|---|
| At least one organic amine | 15–60% |
| Water | 20–60% |
| An ammonium borate compound | 9–20%. |

2. A cleaning formulation as described in claim 1 wherein said ammonium borate compound is selected from the group consisting of ammonium tetraborate and ammonium pentaborate.

3. A cleaning formulation as described in claim 1 further including a polar organic solvent having a percentage by weight range of 0–15%.

4. A cleaning formulation as described in claim 2 further including a polar organic solvent having a percentage by weight range of 0–15%.

5. A cleaning formulation as described in claim 1 wherein said organic amine is selected from the group consisting of:

Monoethanolamine (MEA)

Pentamethyldiethylenetriamine (PMDETA)

Triethanolamine (TEA).

6. A cleaning formulation as described in claim 2 wherein said organic amine is selected from the group consisting of:

Monoethanolamine (MEA)

Pentamethyldiethylenetriamine (PMDETA)

Triethanolamine (TEA).

7. A cleaning formulation as described in claim 3 wherein said organic amine is selected from the group consisting of:

Monoethanolamine (MEA)

Pentamethyldiethylenetriamine (PMDETA)

Triethanolamine (TEA).

8. A cleaning formulation as described in claim 2 wherein said organic amine is selected from the group consisting of:

N-Methyldiethanolamine

Diglycolamine

Diethylethanolamine

Hydroxyethylmorpholine.

9. A cleaning formulation as described in claim 1 further including one or more of the compounds selected from the group consisting of surfactants, stabilizers, corrosion inhibitors, buffering agents, and cosolvents.

10. A semiconductor wafer cleaning formulation for use in post plasma ashing semiconductor fabrication comprising the following components in the percentage by weight ranges shown:

| | |
|---|---|
| TEA | 35.2% |
| Ammonium tetraborate | 11.4% |
| Water | 39% |
| N-Methylpyrrolidone | 14.3%. |

11. A cleaning formulation as described in claim 10 further including one or more components selected from the group consisting of surfactants, stabilizers, corrosion inhibitors, buffering agents, and cosolvents.

12. A semiconductor wafer cleaning formulation for use in post plasma ashing semiconductor fabrication comprising the following components in the percentage by weight ranges shown:

| | |
|---|---|
| MEA | 35% |
| Ammonium tetraborate | 20% |
| Water | 45%. |

13. A cleaning formulation as described in claim 12 further including one or more components selected from the group consisting of surfactants, stabilizers, corrosion inhibitors, buffering agents, and cosolvents.

14. A method for fabricating a semiconductor wafer including the steps comprising:

plasma etching a metalized layer from a surface of the wafer;

plasma ashing a resist from the surface of the wafer following the metal etching step;

cleaning the wafer in a following step using a chemical formulation including the following components in the percentage by weight ranges shown:

| | |
|---|---|
| At least one organic amine | 15–60% |
| Water | 20–60% |
| An ammonium borate compound | 9–20%. |

15. A method described in claim 14 wherein said ammonium borate compound is selected from the group consisting of ammonium tetraborate and ammonium pentaborate.

16. A method as described in claim 14 further including a polar organic solvent having a percentage by weight range of 0–15%.

17. A method as described in claim 15 further including a polar organic solvent having a percentage by weight range of 0–15%.

18. A method as described in claim 14 wherein said organic amine is selected from the group consisting of:

Monoethanolamine (MEA)

Pentamethyldiethylenetriamine (PMDETA)

Triethanolamine (TEA).

19. A method as described in claim 15 wherein said organic amine is selected from the group consisting of:

Monoethanolamine (MEA)

Pentamethyldiethylenetriamine (PMDETA)

Triethanolamine (TEA).

20. A method as described in claim 16 wherein said organic amine is selected from the group consisting of:

Monoethanolamine (MEA)

Pentamethyldiethylenetriamine (PMDETA)

Triethanolamine (TEA).

21. A method as described in claim 15 wherein said organic amine is selected from the group consisting of:

N-Methyldiethanolamine

Diglycolamine

Diethylethanolamine

Hydroxyethylmorpholine.

22. A method as described in claim 14 further including one or more of the compounds selected from the group consisting of surfactants, stabilizers, corrosion inhibitors, buffering agents, and cosolvents.

23. A method for fabricating a semiconductor wafer including the steps comprising:

plasma etching a metalized layer from a surface of the wafer;

plasma ashing a resist from the surface of the wafer following the metal etching step;

cleaning the wafer in a following step using a chemical formulation including the following components in the percentage by weight ranges shown:

| | |
|---|---|
| TEA | 35.2% |
| Ammonium tetraborate | 11.4% |
| Water | 39% |
| N-Methylpyrrolidone | 14.3%. |

24. A method as described in claim 23 wherein said formulation further includes one or more components selected from the group consisting of surfactants, stabilizers, corrosion inhibitors, buffering agents, and cosolvents.

25. A method for fabricating a semiconductor wafer including the steps comprising:

plasma etching a metalized layer from a surface of the wafer;

plasma ashing a resist from the surface of the wafer following the metal etching step;

cleaning the wafer in a following step using a chemical formulation including the following components in the percentage by weight ranges shown:

| | |
|---|---|
| MEA | 35% |
| Ammonium tetraborate | 20% |
| Water | 45%. |

26. A method as described in claim 25 wherein said formulation 19 further includes one or more components selected from the group consisting of surfactants, stabilizers, corrosion inhibitors, buffering agents, and cosolvents.

* * * * *